United States Patent [19]

Strub

[11] 4,367,613

[45] Jan. 11, 1983

[54] STAIRS AND METHOD OF MAKING THE SAME

[76] Inventor: Robert D. Strub, 817 S. Capitol, Iowa City, Iowa 52240

[21] Appl. No.: 236,036

[22] Filed: Feb. 20, 1981

[51] Int. Cl.[3] ..... E04F 11/00

[52] U.S. Cl. ..... 52/188; 52/191; 52/741

[58] Field of Search ..... 52/188, 191, 182, 741, 52/183, 646, 184, 185

[56] References Cited

U.S. PATENT DOCUMENTS

| | | | |
|---|---|---|---|
| 1,893,876 | 1/1933 | Anderson | 52/191 |
| 3,393,481 | 7/1968 | Meuret | 52/188 |
| 4,124,957 | 11/1978 | Poulain | 52/183 |
| 4,154,032 | 5/1979 | Strub | 52/188 |

*Primary Examiner*—Price C. Faw, Jr.

*Assistant Examiner*—Carl D. Friedman

*Attorney, Agent, or Firm*—James C. Nemmers; Haven E. Simmons

[57] ABSTRACT

A construction for wooden stairs that permits standardized, factory machined components to be pre-packaged and shipped to the job site where they can be installed to fit almost any installation. The structure includes stringers which have riser and tread receiving grooves on both sides. The grooves on each side of the stringer provide for a different rise and run rate. The construction technique and the resulting stairs substantially reduces the job-site layout and assembly time from that required with conventional stairs. It also reduces the number of components that must be produced and stocked. The technique is especially applicable when employed with wooden stairs of the interlocking type that generally need no fasteners, adhesives or wedges.

8 Claims, 9 Drawing Figures

STAIRS AND METHOD OF MAKING THE SAME

BACKGROUND OF THE INVENTION

Wooden stairs have been used for many, many years in all types of residential construction. The standard closed stairs consist of two parallel spaced apart members, called housing or stringers, which support a sufficient number of treads and risers to span the distance between the two levels for which the stairs are designed. The stairs are usually laid out on the job site. The conventional method of preparing the components for assembly of the stairs is to use a router on the job site to machine grooves at the appropriate locations in each of the stringers. These grooves are generally tapered and they receive the treads and risers at right angles to each other to form the stairs. The tapered grooves provide for the use of wedges so that the treads and risers can be properly positioned relative to each other. Once properly positioned, each of the treads and risers is secured in place by nailing, by the use of a suitable adhesive or by using other fasteners. The most common method is to nail the treads and risers in place, and if the appearance of the stairs is important, moldings can be used to cover the nail heads. Moreover, even if the components of the stairs are premachined in a manufacturing plant, it is virtually impossible to cut and fit the risers and treads so as to eliminate all gaps between them. Moldings can then be used to cover these gaps.

Stairs constructed using the foregoing described conventional technique can be custom produced and assembled in a manfacturing plant and then shipped to the job site for installation. Such stairs are obviously bulky and expensive to ship, and must be installed in the proper sequence of construction or it may become difficult to install the stairs. Moreover, the contractor must make certain that the distance to be spanned by the stairs between the two levels and the opening for the stairs are accurately measured and constructed. If not, the premanufactured stairs may be very difficult to install. To avoid these problems, it is sometimes customary for the stairs to be cut, assembled and installed on the job site. This, of course, requires more time since mass production factory techniques cannot be employed. In either event, however, it generally requires sixteen or more man hours to layout, cut the components and assemble the stairs. This time can be considerably more where more expensive decorative woods are used instead of pine or fir. Stairs, therefore, can be a relatively expensive portion of a construction project.

Many of the disadvantages of constructing stairs using the foregoing described conventional techniques can be eliminated by the use of the interlocking techniques disclosed and claimed in my prior U.S. Pat. No. 4,154,032 issued May 15, 1979 and entitled "Stairs and Method of Making Same." However, even with these techniques the stringers must be individually machined to produce the proper rise and run so that the completed stairs will fit properly.

When using the techniques of the invention described herein, the layout, cutting and assembly time of any stairs, either conventional or interlocking, can be substantially reduced thus reducing the cost. With the interlocking stairs, the time for installation in the field is one man hour or less. Moreover, the cost of producing and stocking the components can be reduced because the components are standardized regardless of the opening where the stairs is to be installed.

SUMMARY OF THE INVENTION

If the interlocking stairs are to be produced using the principles of the invention, both sides of the stringers are machined with a router to form a dovetail dado for each tread and riser. The relative location of the dado for each tread and riser is different on each side of the stringer. Then, the right and left hand edges of each tread and riser are machined to form a male dovetail, the treads being further machined to provide a backcut on the dovetail at the nose of each tread. Each tread is then again machined to form a dado from end to end along a line parallel with but spaced rearwardly from the nose of the tread. This dado is formed in the bottom surface of each tread, and along the rear edge of each tread a rabbet is formed. The front surface of each riser also has a dado formed in it from end to end along a line parallel with the top and bottom edges of the riser and in a position where the tread will be engaging the riser. A similar dado is formed on the back side of each riser in a position where the tread will engage the riser if the riser is inverted to provide a stair with a different rise. Depending upon the desired rise and run, the stairs are then assembled by positioning the stringers with the matched selected sides facing each other and by sliding the treads into position in the stringers with the treads moved forwardly as far as possible and beyond their final position. The risers, each with the selected dado position facing forward, are then slid into position in their respective grooves in the stringers, but the treads are not advanced into their final positions. The first riser and tread are then interlocked, and then the second tread is moved back from its forwardmost position and locked into the dado in the first riser. This sequence is repeated for each riser and tread until the last riser is inserted and locked into the last tread. This locks the entire assembly, and when the assembled stairs are installed, it is impossible for any of the treads or risers to move from their locked position. Since the grooves formed on the opposite sides of the stringers also match if the stringers are inverted and interchanged, and if the risers are also inverted, a stair with a different rise and run can be assembled using the same components.

DESCRIPTION OF THE PREFERRED EMBODIMENT OF THE INVENTION

Figure 1:
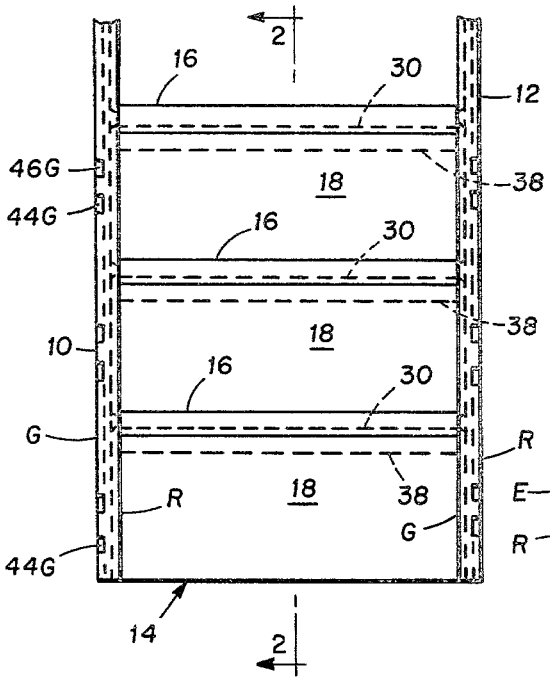
FIG. 1 is a front elevational view of a portion of an interlocking type stairs constructed according to the invention.

The drawings illustrate an interlocking-type stairs constructed according to the principles of the invention. I have shown the invention in connection with the interlocking-type stairs disclosed in my U.S. Pat. No. 4,154,032, but the principles of the invention are equally applicable to conventional stairs. Because of the standardization of components that is provided for by my invention, it is necessary that the stairs be assembled with the components in their proper positions. To clarify the matching surfaces, I have used the designation "R" and "G" to identify the surfaces of the components that must be matched when the components are assembled in the two different ways described herein.

The illustrated stairs, like conventional stairs, have side housings or stringers 10 and 12 which extend from the floor line 14 upwardly at an angle to the next level. The stringers 10 and 12 each have a surface R and a surface G opposite surface R which surfaces are machined with grooves in the manner described hereinafter. The stringers 10 and 12 are positioned in parallel relationship with either surfaces R or G facing each other, and the stringers are joined by a plurality of treads 16 and risers 18, the treads 16 being positioned horizontally with the risers 18 vertical. The distance from the front surface of one riser perpendicularly to the front surface of the next riser 18 is the "run" and this distance is indicated by the letter "A" in FIG. 2. The full distance of a tread 16 from the face or front surface of a riser 18 to the nose 22 of the tread is referred to as the "tread", and this distance is indicated by the letter "B" in FIG. 2. The difference between the tread B and run A is the nosing. Also, as is known to those skilled in the art, the distance from the top of a tread 16 to the top of the next tread 16 is the "rise", and this distance is indicated by the letter "C" in FIG. 2.

Figure 3:
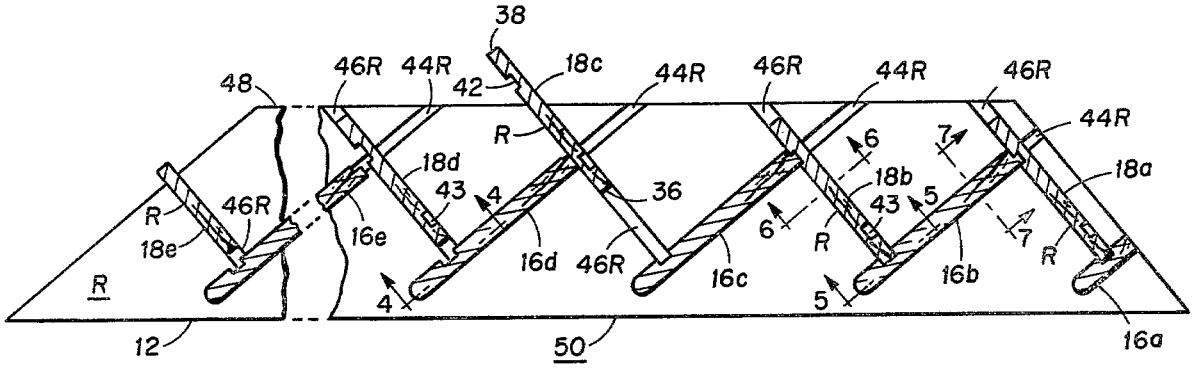
FIG. 3 is a plan view of a stringer with treads and risers shown in various positions to illustrate the method of assembly of the interlocking type stairs.

Referring to FIG. 3, there is illustrated one of the stringers, stringer 12, in a plan view showing the inside surface R of the stringer 12 with the stringer inverted from its normal position when the stairs are installed. The opposite surface of stringer 12 (the outside surface of the assembly shown in FIG. 1A) is designated by the letter G. For purposes of illustration, the treads 16 and risers 18 shown in FIG. 3 are shown in section to clarify their position in the stages of assembly. The other stringer 10 is not shown in FIG. 3, but stringer 10 also has an inside surface R (FIG. 1A) and an outside surface G. However, before describing the assembly steps, the construction of each tread 16 and each riser 18 will be described.

Figure 8:
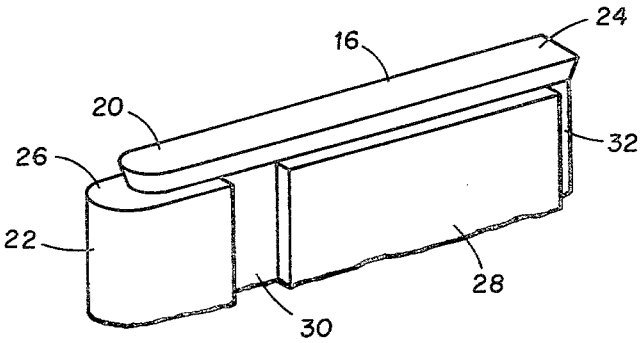
FIG. 8 is a perspective view of one end of a tread showing the male dovetail and backcut formed on each end of the tread.

Referring to FIG. 8, there is shown a perspective view of a portion of one end of a tread 16. Along each end of tread 16 there is machined a male dovetail 20 that is backcut from the nose 22 for a purpose which will be evident from the stages of assembly described hereinafter. The male dovetail 20 extends the full distance from the back edge 24 of tread 16 to the nose 22 except for the backcut portion 26. There is also machined in the bottom surface 28 of each tread 16 a dado 30 which extends the full width of the tread 16 parallel to the back edge 24. There is also machined along the back edge 24 of each tread 16 at the bottom surface 28 a rabbet 32.

Figure 1A:
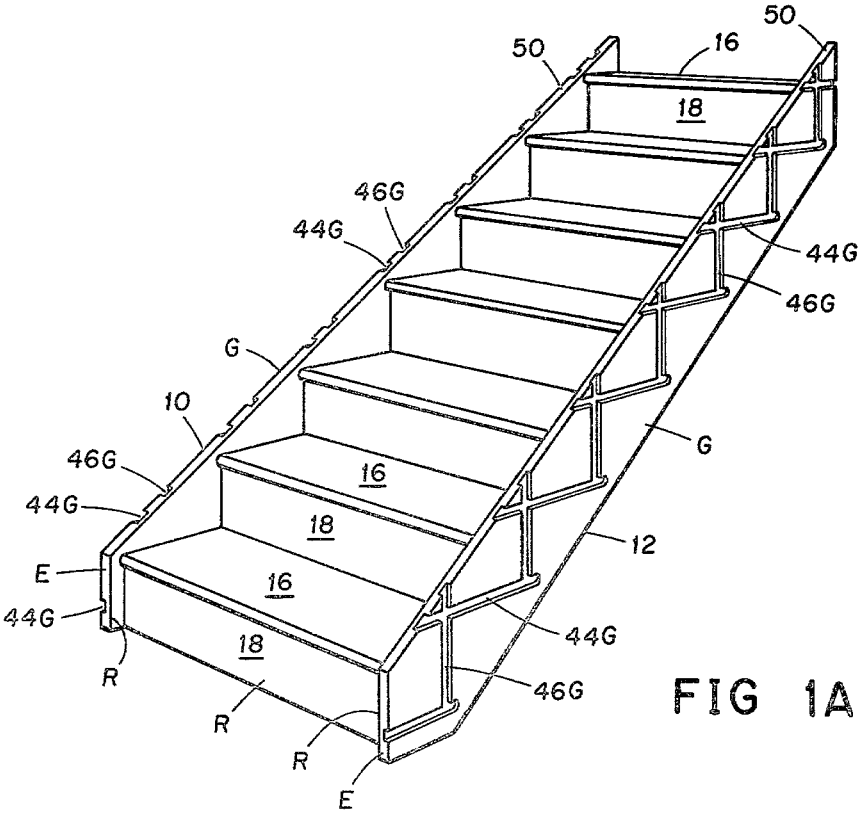
FIG. 1A is a perspective view of interlocking type stairs constructed according to the invention and showing the grooves formed on the stringers.

Each riser 18 has machined along each end a male dovetail 34 similar to the male dovetail 20 of tread 16. However, the male dovetail 34 of each riser 18 extends the full length along each end from the top edge 36 to the bottom edge 38. There is also machined in one surface R of each riser 18 (the front surface of the assembly of FIG. 1A) a dado 42 which dado is parallel to the top edge 36 and is spaced from the top edge a distance approximately equal to the rise C of the stairs when assembled as shown in FIG. 1A with surfaces R of the stringers 10 and 12 facing inside. Each riser 18 also has machined in its opposite surface G a dado 43 which dado 43 is parallel to the bottom edge 38 and spaced from it a distance equal approximately to the rise C of the stairs when the stairs are assembled with the surfaces G of the stringers 10 and 12 facing each other. The depth of dado 43 is different from the depth of dado 42 so that the run A can be varied depending upon which surface R or G of the riser 18 faces the nose of the tread.

The inside surface R of each stringer 10 and 12 is machined with a plurality of female dovetails 44R and 46R, dovetail 44R being machined to receive a tread 16 while dovetail 46R is machined to receive a riser 18. As best seen in FIG. 3, female dovetails 44R and 46R are cut starting from the lower longitudinal edge 48 toward the upper longitudinal edge 50. The length of each dovetail 44R and 46R is such to receive a tread 16 and a riser 18 in their respective final positions in the assembled stairs.

Similarly, the surface G of each stringer 10 and 12 is machined with a plurality of female dovetails 44G and 46G. However, the rise C and run A formed by dovetails 44G and 46G are different from the rise C and run A formed in the surface R by dovetails 44R and 46R, as will be explained more fully hereinafter. As illustrated in FIG. 1A, dovetails 44G and 46G on surface G are cut starting from the longitudinal edge 50 toward the edge 48 and thus are inverted from dovetails 44R and 46R on surface R. This inversion is not necessary to practice the invention but is done so that the dovetails on surface G of stringers 10 and 12 will be offset from the dovetails R of the stringers to provide for maximum strength and rigidity of the stringers 10 and 12.

Of course, the shape and size of the female dovetails 44G and 44R and 46G and 46R correspond to the dimensions of the male dovetails 20 and 34 for the treads 16 and risers 18, respectively.

I have determined that by using the principles of the invention and machining the stringers on the G surfaces so that the rise C is 7 23/32" and the run A is 9 15/32" and machining the R surfaces to produce a rise C of 7 29/64" and a run A of 9 43/64", the same components will in fact fit 99% of all installations requiring a stair of a given width. Of course, the dimensional location of the dados 42 and 43 in risers 18 is determined according to the different rises and runs, and once determined, permits a standard riser to be produced for all stairs. Also, the depth of the dado 42 in the surface R of the riser 18 will not be as great as the depth of dado 43 in surface G. This is to compensate for the shorter run A when the "G" assembly is used. These dimensions can be varied slightly without affecting the utility of the invention. The cost of machining the extra set of grooves in each stringer is small in comparison to the savings in standardized components. Also, the exposed unused grooves in the stringers present no problem since these surfaces of the stringers are normally covered anyway by trim or decorative materials in all stair installations.

Figure 2:
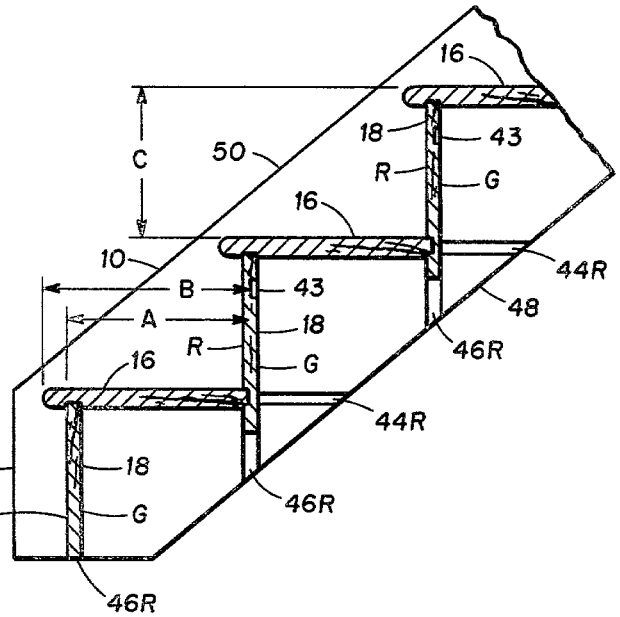
FIG. 2 is a sectional view of the stairs taken on the line 2—2 of FIG. 1.
Figure 4:
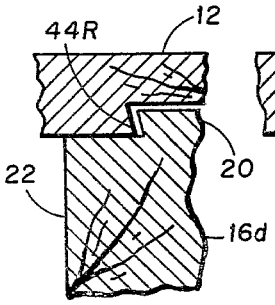
FIGS. 4, 5, 6 and 7 are sectional views taken along the lines 4—4, 5—5, 6—6 and 7—7 of FIG. 3 respectively.
Figure 5:
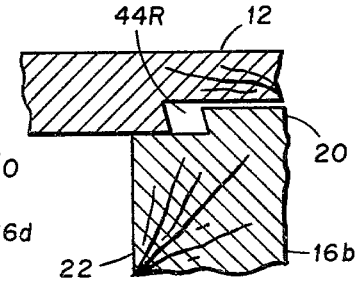
Figure 6:
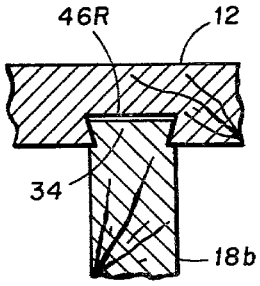
Figure 7:
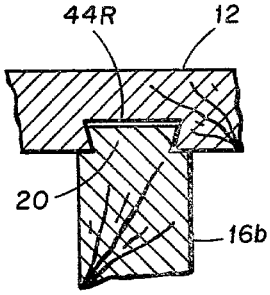

Referring now to FIG. 3, and also to FIGS. 4 through 7, the steps or stages of the "R" assembly of the treads 16, risers 18 and stringers 10 and 12 will be described. FIG. 3 shows the surface R of stringer 12 and also shows the end of the stringer not yet cut at the bottom front, floor level which it would be when the stairs are assembled and in place. FIGS. 1A and 2 show this cut having been made along the edge E of both stringers 10 and 12. During assembly, the stringers 10 and 12 are inverted on a flat horizontal surface with the upper edge 50 of each stringer resting on the surface. The stringers 10 and 12 are positioned parallel to each other with surfaces R facing and spaced apart a width corresponding to the width of the stairs when the assembly is completed. Referring to FIG. 3, the first or top tread 16*a* is slid into its final position in the stringer 12 by sliding the male dovetail 20 into the female dovetail 44R. Then, one or more treads 16*b*, 16*c*, 16*d* and 16*e* are all slid into place in a similar manner. However, treads 16*b*, 16*c*, 16*d* and 16*e* are fully inserted until the leading edge of the male dovetail 20 engages the end of the female dovetail 44R. This is illustrated in FIG. 4. In this position, as illustrated by the position of tread 16*d* in FIG. 3, the back edge 24 of the tread is beyond the preceding female dovetail 46R. The backcut 26 on each end of the tread 16 permits the tread to be moved to this advanced position and allows the risers 18 to be slid completely into female dovetails 46R near their final position. As illustrated by riser 18*c* in FIG. 3, the riser can be moved into its position by sliding the male dovetail 34 into the female dovetail 46R. If surfaces R of the stringers 10 and 12 are facing inside, each riser 18 must be positioned with its surface R facing toward the nose of the tread 16 so that the dado 42 will be in position to engage the rabbet 32 of the corresponding tread 16. Each riser 18 is advanced into position until its top edge 36 is engaged in the dado 30 in the bottom surface 28 of the preceding tread 16 that has been moved to its final position. Treads 16*a* and 16*b* are shown in their final position, and is illustrated in FIG. 3, the top edge 36 of the risers 18*a* and 18*b* are engaged in the dados 30. When in this position, it is clear that treads 16*a* and 16*b* along with riser 18*a* are locked in position and cannot be moved. The riser 18*a* is locked in position by reason of engagement of the rabbet 32 of tread 16*b* with the dado 42 of the riser. This locking is accomplished by sliding the tread 16*b* back away from its advanced position into its final position in which the dado 30 of the tread is in alignment with the next female dovetail 46R ready to receive the top edge 36 of the next riser 18.

The foregoing described procedure is repeated in sequence until each of the treads 16 and risers 18 have been moved to their final position interlocked with each other. Insertion of the final riser 18*e* with its top edge 36 engaged in dado 30 of tread 16*e* completes the assembly of the stairs. When the stairs are installed, the bottom edge of riser 18*e* will rest on floor line 14 thus making it impossible for any of the treads 16 or risers 18 to move. Of course, if for any reason it became necessary to disassemble the stairs, the assembly process can be reversed and each of the treads 16 and risers 18 slid out of engagement with the stringers 10 and 12.

The foregoing construction and assembly has been described for the "R" assembly with the surfaces R of stringers 10 and 12 facing inside and surfaces R of risers 18 facing forwardly. This assembly forms a stair having the predetermined rise C and run A previously indicated. If, however, a stair is needed with the different rise C and run A previously indicated, the "G" assembly is used with the stringers 10 and 12 inverted and interchanged from their positions shown in FIG. 1A so that surfaces G are facing each other. Also, risers 18 are reversed so that the surface G of each riser faces forwardly. I have determined that by the proper layout and dimensions of the female dovetails 44R and 46R and 44G and 46G on the sides of the stringers 10 and 12, and by the proper location of dado 42 in surface R and dado 43 in surface G of each riser 18, a stair can be assembled to fit almost any installation using the standardized components of the stringers 10 and 12, and risers 18 and treads 16. Of course, one set of standardized components will produce stairs of only a single width, but the same components can be arranged to fit different floor-to-floor or floor-to-landing arrangements by cutting the stringers to the desired length. No customized layout or special fitting is required, thus eliminating the time consuming and error-prone process of layout and assembly. These factory produced, standardized components will thus provide a high-quality stair.

Having thus described my invention, it will be obvious to those skilled in the art that various revisions and modifications can be made to the preferred embodiment described herein without departing from the spirit and scope of the invention. It is my intention, however, that all such revisions and modifications as are obvious to those skilled in the art will be included within the scope of the following claims.

I claim:

1. A construction for wooden stairs to span the distance between a lower level and an upper level, said stairs comprising longitudinally extending spaced-apart stringers each having a first side and a second side opposite thereto, said stringers extending from the lower level to the upper level, a plurality of treads extending between said stringers in longitudinally spaced-apart horizontal planes according to a predetermined rise, a plurality of risers alternating with said treads and extending between said stringers in longitudinally spaced-apart vertical planes according to a predetermined run, spaced-apart grooves formed in the first side of each of said stringers to receive the ends of said treads and position them according to a first predetermined rise when said stairs are assembled with said first sides of said stringers facing each other, spaced-apart grooves formed in the second side of each of said stringers to receive the ends of said treads and position them according to a second predetermined rise when said stairs are assembled with said second sides of said stringers facing each other, and means to hold said stringers, treads and risers in assembled condition to form a completed stairs with a predetermined rise and run depending upon the selected position of said stringers.

2. The wooden stairs construction of claim 1 in which there are spaced-apart grooves formed in the first side of each of said stringers to receive the ends of said risers and position them according to a first predetermined run when said stairs are assembled with said first sides of said stringers facing each other, and spaced-apart grooves formed in the second side of each of said stringers to receive the ends of said risers and position them according to a second predetermined run when said stairs are assembled with said second sides of said stringers facing each other.

3. The wooden stairs construction of claim 2 in which the bottom width of each of the grooves formed to receive a riser is greater than the width of the groove at the surface of the stringer, and a male portion is formed on each end of each riser to a cross-sectional shape corresponding to the cross-sectional shape of the corresponding grooves in the stringers so that said male portions of the risers are slideably receivable in the respective grooves of said stringers.

4. The wooden stairs construction of claim 3 in which the male portion formed on each end of each tread extends from the rear edge of the tread to a point spaced rearwardly from the front edge of said tread, the distance of said point from the front edge of the tread being at least as great as the thickness of a riser.

5. The wooden stairs construction of claim 4 in which the cross-sectional shape of all of the grooves in both sides of said stringers are a dovetail shape, the male portions formed on the ends of each tread are corresponding male dovetail shape in cross-section, and the male portion formed on the ends of each riser are a corresponding male dovetail shape in cross-section.

6. The wooden stairs construction of claim 1 in which the bottom width of each of said grooves formed to receive a tread is greater than the width of the groove at the surface of the stringer, a male portion is formed on each end of each tread to a cross-sectional shape corresponding to the cross-sectional shape of the corresponding grooves in said stringers so that said male portions are slideably receivable in the respective grooves of said stringers, each of said treads having a groove formed in the bottom surface thereof parallel to and spaced from the front edge of the tread so as to receive therein the top edge of a riser, and each of said risers having a groove formed in the front and rear surfaces thereof parallel to and spaced from the top edge of the riser so that the rear edge of a tread is received in one of said grooves depending upon the selected position of the risers.

7. The wooden stairs construction of claims 6, 3, 4 or 5 in which there is a rabbet formed along the rear edge of each tread where the rear edge joins the bottom surface of the tread, and the grooves formed in the front and rear surfaces of each riser is of a size corresponding to the rear edge of the tread remaining after the rabbet has been formed.

8. A method for constructing stairs in which the rise and the run can be varied using the same components of a pair of parallel spaced-apart stringers each having a first surface and a second surface opposite thereto and alternating treads and risers positioned between said stringers, said method comprising: forming in said first surface of each of said stringers a plurality of generally horizontal parallel grooves spaced-apart a predetermined distance to provide for a first predetermined rise; forming in said second surface of each of said stringers a plurality of generally horizontal parallel grooves spaced-apart a predetermined distance to provide for a second predetermined rise; positioning said stringers with the first or second surfaces facing each other depending upon the desired rise of the assembled stairs; positioning said treads in the grooves of the facing surfaces of said stringers; and fastening said treads, risers and stringers together into an assembled stairs.

* * * * *